US005899192A

United States Patent [19]

Tsutsumi et al.

[11] Patent Number: 5,899,192

[45] Date of Patent: May 4, 1999

[54] FUEL SUPPLY CONTROL SYSTEM FOR INTERNAL COMBUSTION ENGINES

[75] Inventors: Kojiro Tsutsumi; Katsushi Watanabe; Takeshi Fukuzawa, all of Wako, Japan

[73] Assignee: Honda Hiken Kogyo Kabushiki Kaisha, Tokyo, Japan

[21] Appl. No.: 08/954,042

[22] Filed: Oct. 20, 1997

[30] Foreign Application Priority Data

Oct. 18, 1996 [JP] Japan ..... 8-297396

[51] Int. Cl.[6] ..... F02M 51/00

[52] U.S. Cl. ..... 123/492; 123/681

[58] Field of Search ..... 123/492, 681; 60/285

[56] References Cited

U.S. PATENT DOCUMENTS

| | | | |
|---|---|---|---|
| 5,158,060 | 10/1992 | Hara | 123/492 |
| 5,353,769 | 10/1994 | Maeda et al. | 123/492 |
| 5,358,126 | 10/1994 | Ogawa et al. | 123/492 |
| 5,494,019 | 2/1996 | Ogawa | 123/492 |
| 5,542,393 | 8/1996 | Katoh et al. | 123/492 |
| 5,568,799 | 10/1996 | Akazaki et al. | 123/492 |
| 5,629,853 | 5/1997 | Ogawa et al. | 123/492 |

FOREIGN PATENT DOCUMENTS 53-8427 1/1978 Japan .

*Primary Examiner*—John Kwon

*Attorney, Agent, or Firm*—Nikaido, Marmelstein, Murray & Oram LLP

[57] ABSTRACT

A fuel supply control system for an internal combustion engine. A load condition sensor detects a load condition of the engine, and an ECU increases the amount of fuel to be supplied to the engine when a predetermined high load condition of the engine is detected by the load condition sensor, and sets a delay time period from detection of the predetermined high load condition of the engine by the load condition sensor to execution of increase of the amount of fuel, according to operating conditions of the engine. A time period elapsed from the detection of the predetermined high load condition is counted. The set delay time period is corrected based on a ratio of the set delay time period to the counted time period and the load condition of the engine detected by the load condition sensor before the detection of said predetermined high load condition.

13 Claims, 8 Drawing Sheets

FUEL INJECTION VALVE
THREE-WAY CATALYST
INTERNAL COMBUSTION ENGINE
NE
CYL
NE
CRK
TW
TA
PB
θTH
M
O2
INPUT CIRCUIT
CPU
MEMORY CIRCUIT
OUTPUT CIRCUIT
ECU
AP
VP
RP
1
2
3
4
5
5a
5b
5c
5d
6
7
8
9
10
11
12
13
14
15
16
18
19
23
24
25
27

FUEL SUPPLY CONTROL SYSTEM FOR INTERNAL COMBUSTION ENGINES

BACKGROUND OF THE INVENTION

1. Field of the Invention

This invention relates to a fuel supply control system for internal combustion engines, which operates to increase the amount of fuel to be supplied to the engine when a high load condition of the engine is detected.

2. Prior Art

In a conventional fuel supply control system for internal combustion engines, when the engine enters a predetermined high load condition, a fuel amount supplied to the engine is increased by multiplying a basic fuel amount by a predetermined coefficient, to thereby enrich the air-fuel ratio of a mixture supplied to the engine, immediately after the opening of a throttle valve of the engine exceeds a predetermined value corresponding to the predetermined high load condition, or upon the lapse of a predetermined time period (e.g. approximately 1 second) after the absolute value of pressure within the intake pipe of the engine exceeds a predetermined value corresponding to the predetermined high load condition. By virtue of this increase of the fuel supply amount, not only the engine output can be increased in the high load condition, but also the combustion temperature of the engine can be lowered to prevent a rise in the temperature of a catalyst arranged in the exhaust system of the engine, to thereby prevent the catalyst from being deteriorated or damaged by heat.

Further, an air-fuel ratio feedback control system is known, e.g. from Japanese Laid-Open Patent Publication (Kokai) No. 53-8427, which increases the fuel supply amount by terminating air-fuel ratio feedback control when the pressure of intake air into the engine continuously exceeds a predetermined value over a predetermined time period. As a result, even when the engine is in a high rotational speed and high load condition in which an increased intake air amount is supplied to the engine, a high engine output can be obtained and good performance of the catalyst can be maintained.

According to the conventional fuel supply control systems, however, when it is determined that the engine is in the high load condition, the increase of the fuel supply amount is carried out even if the catalyst temperature is low and does not reach a value at or above which the catalyst can be deteriorated or damaged by heat. This is disadvantageous in respect of exhaust emission characteristics and fuel economy.

SUMMARY OF THE INVENTION

It is the object of the invention to provide a fuel supply control system for internal combustion engines, which is capable of carrying out increase of the fuel supply amount at timing suitable for the temperature of the catalyst, thereby improving the exhaust emission characteristics and fuel economy as well as preventing the catalyst from being deteriorated or damaged by heat.

To attain the above object, the present invention provides a fuel supply control system for an internal combustion engine, comprising:

load condition-detecting means for detecting a load condition of the engine;

fuel amount-increasing means for increasing an amount of fuel to be supplied to the engine when a predetermined high load condition of the engine is detected by the load condition-detecting means;

delay time-setting means for setting a delay time period from detection of the predetermined high load condition of the engine by the load condition-detecting means to execution of increase of the amount of fuel by the fuel amount-increasing means, according to operating conditions of the engine;

counting means for counting a time period elapsed from the detection of the predetermined high load condition; and correcting means for correcting the delay time period set by the delay time-setting means, based on a ratio of the set delay time period to the time period counted by the counting means and the load condition of the engine detected by the load condition-detecting means before the detection of the predetermined high load condition.

Preferably, the correcting means decreases the delay time period when load on the engine detected by the load condition-detecting means is larger than a predetermined value to be assumed immediately before the engine enters the predetermine high load condition, and increases the delay time period when the load on the engine is smaller than the predetermined value.

Also preferably, the delay time-setting means sets the delay time period, based on rotational speed of the engine assumed immediately before the engine enters the predetermined high load condition.

More preferably, the delay time-setting means sets the delay time period to a shorter value as the rotational speed of the engine is higher.

Preferably, the correcting means decreases the delay time period by subtracting a predetermined subtrahend from a residual delay time ratio which is a ratio of a residual time period of the counting means to the delay time period when the load on the engine detected by the load condition-detecting means is smaller than the predetermined value, and increases the delay time period by adding a predetermined addend to the residual delay time ratio when the load on the engine is larger than the predetermined value.

More preferably, the predetermined subtrahend is equal to a ratio of a time period required for temperature of a catalyst arranged in the exhaust system to rise from a temperature value to be assumed immediately before the engine enters the predetermined high load condition to a predetermined high temperature value to a time interval of the subtraction of the predetermined subtrahend from the residual delay time ratio by the correcting means. The predetermined addend is equal to a ratio of a time period required for temperature of the catalyst to decline from the predetermined high temperature value to the temperature value to be assumed immediately before the engine enters the predetermined high load condition to a time interval of the addition of the predetermined addend to the residual delay time ratio.

Further preferably, the predetermined high temperature value is a value which the temperature of the catalyst can assume when the delay time period has elapsed after the engine entered the predetermined high load condition.

Preferably, the delay time-setting means sets the delay time period by multiplying a basic delay time period by the residual delay time ratio, the basic delay time period being set according to rotational speed of the engine.

More preferably, the air-fuel ratio control system includes limiting means operable when the residual delay time ratio after the subtraction of the predetermined subtrahend therefrom falls below a predetermined lower limit value and when the residual delay time ratio after the addition of the predetermined addend thereto exceeds a predetermined upper limit value, for limiting the residual delay time ratio to the predetermined lower limit value and limiting to the predetermined upper limit value, respectively. The predetermined lower limit value is set to a value such that the delay time period is made equal to 0, and the predetermined higher limit value is set to a value such that the delay time period is not corrected.

The predetermined lower limit value corresponds to the predetermined high temperature value.

The predetermined upper limit value corresponds to the temperature value to be assumed by the catalyst immediately before the engine enters the predetermined high load condition.

The above and other objects, features and advantages of the invention will become more apparent from the following detailed description taken in conjunction with the accompanying drawings.

BRIEF DESCRIPTION OF THE DRAWINGS

FIGS. 8A to 8E collectively form a timing chart showing changes in intake pipe absolute pressure PBA, a residual delay time ratio DLYCONS, the count value of a down-counting timer tmWOTDLY, an immediately-before-WOT determination flag FTMWOT, and a WOT determination flag FWOT, wherein:

FIG. 8A shows a change in the PBA value;

FIG. 8B shows a change in the residual delay time ratio DLYCONS;

FIG. 8C shows a change in the count value of the down-counting timer tmWOTDLY;

FIG. 8D shows a change in the immediately-before-WOT determination flag FTMWOT; and FIG. 8E shows a change in the WOT determination flag.

DETAILED DESCRIPTION

The invention will now be described in detail with reference to the drawings showing an embodiment thereof.

Figure 1:
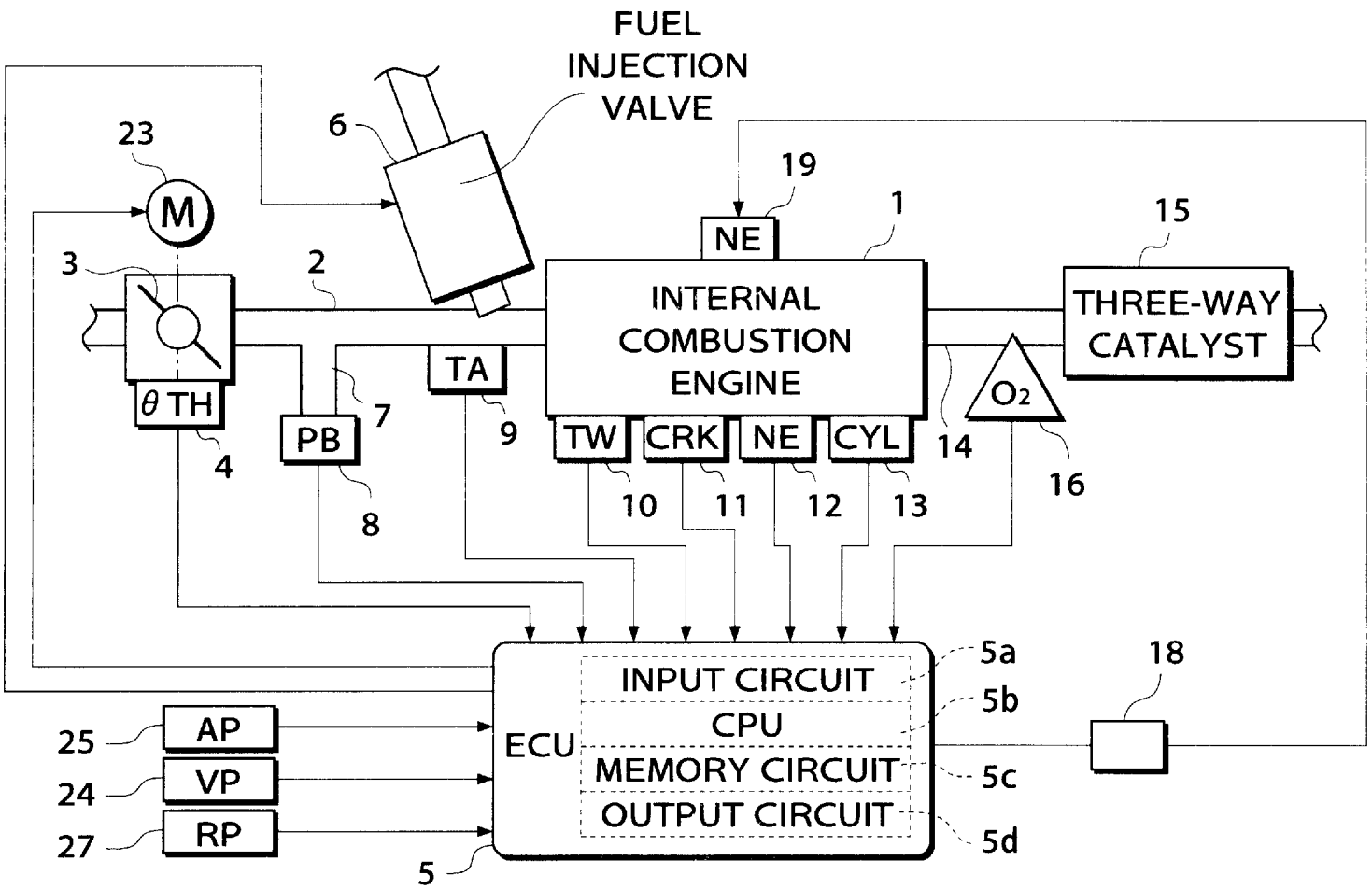
FIG. 1 is a block diagram schematically showing the whole arrangement of an internal combustion engine and a fuel supply control system therefor, according to an embodiment of the invention.

Referring first to FIG. 1, there is illustrated the whole arrangement of an internal combustion engine (hereinafter simply referred to as "the engine") and a fuel supply control system therefor, according to an embodiment of the invention.

In the figure, reference numeral 1 designates an internal combustion engine, which has a cylinder block to which is connected an intake pipe 2. A throttle valve 3 is arranged in the intake pipe 2. A throttle valve opening (TH) sensor 4 is connected to the throttle valve 3 and electrically connected to an electronic control unit (hereinafter referred to as "the ECU") 5, for generating an electric signal indicative of the sensed throttle valve opening TH to the ECU 5.

Further electrically connected to the ECU 5 are a throttle actuator 23 for driving the throttle valve 3 and an accelerator pedal position (AP) sensor 25 for detecting the position AP of an accelerator pedal, not shown, of a vehicle in which the engine is installed. The ECU 5 controls the operation of the throttle actuator 23 in response to the accelerator pedal position AP detected by the accelerator pedal position sensor 25.

Fuel injection valves 6, only one of which is shown, are inserted into the intake pipe 2 at locations intermediate between the cylinder block of the engine 1 and the throttle valve 3 and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is communicated with the interior of the intake pipe 2 via a conduit 7 at a location immediately downstream of the throttle valve 3, for sensing absolute pressure or intake pressure (PBA) within the intake pipe 2, and is electrically connected to the ECU 5, for supplying an electric signal indicative of the sensed absolute pressure PBA to the ECU 5. Further, an intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1 which is filled with engine coolant, for supplying an electric signal indicative of the sensed engine coolant temperature TW to the ECU 5.

A cylinder-discriminating sensor (hereinafter referred to as "the CYL sensor") 13, an engine rotational speed (NE) sensor 12, and a crank angle (CRK) sensor 11 are arranged in facing relation to a camshaft or a crankshaft of the engine 1, neither of which is shown. The CYL sensor 13 generates a signal pulse (hereinafter referred to as "a CYL signal pulse") at a predetermined crank angle of a particular cylinder of the engine 1. The NE sensor 12 generates a signal pulse (hereinafter referred to as "a TDC signal pulse") for detecting the rotational speed NE of the engine, at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the intake stroke of the cylinder. The CRK sensor 11 generates a signal pulse (hereinafter referred to as "a CRK signal pulse") at one of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5.

A spark plug 19 is arranged in each cylinder of the engine 1 and electrically connected to the ECU 5 through a distributor 18.

Further electrically connected to the ECU 5 is a vehicle speed sensor 24 for detecting the traveling speed (vehicle speed) VP of the vehicle and supplying a signal indicative of the sensed vehicle speed VP to the ECU 5.

A three-way catalyst (catalytic converter, and hereinafter simply referred to as "the catalyst") 15 is arranged in an exhaust pipe 14 of the engine 1, for purifying noxious components in exhaust gases emitted from the engine 1, such as HC, CO, and NOx. An oxygen concentration sensor (hereinafter referred to as "the O2 sensor") 16 as an air-fuel ratio sensor is arranged in the exhaust pipe 14 at a location upstream of the catalyst 15, which detects the concentration of oxygen present in exhaust gases and supplies an electric signal indicative of the sensed oxygen concentration to the ECU 5.

The ECU 5 is comprised of an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as the "the CPU") 5*b*, a memory circuit 5*c* storing various operational programs which are executed by the CPU 5*b*, and for storing results of calculations therefrom, etc., and an output circuit 5*d* which supplies driving signals to the fuel injection valves 6, the distributor 18, etc.

The CPU 5*b* operates in response to signals from various engine operating parameter sensors including those mentioned above to determine operating conditions in which the engine 1 is operating, such as an air-fuel ratio feedback control region in which air-fuel ratio control is carried out in response to the oxygen concentration of exhaust gases detected by the O2 sensor 16, and air-fuel ratio open-loop control regions, and calculates, based upon the determined engine operating conditions, a fuel injection period Tout for each of the fuel injection valves 6, in synchronism with generation of TDC signal pulses, by the use of the following equation (1):

$$Tout=Ti\times KO2\times K1+K2 \quad (1)$$

where Ti represents a basic value of the fuel injection period Tout, which is determined according to the engine rotational speed NE and the intake pipe absolute pressure PBA, by the use of a Ti map, not shown, which is stored in the memory circuit 5*c*.

KO2 represents an air-fuel ratio correction coefficient calculated based on the output signal from the O2 sensor 16, which is calculated to such a value that the air-fuel ratio of an air-fuel mixture supplied to the engine 1 becomes equal to a desired air-fuel ratio when the engine 1 is operating in the air-fuel ratio feedback control region, while it is set to predetermined values corresponding to the respective air-fuel ratio open-loop control regions of the engine 1 when the engine 1 is in these open-loop control regions.

K1 and K2 represent other correction coefficients and correction variables, respectively, which are set according to engine operating parameters to such values as optimize engine operating characteristics, such as fuel consumption and engine accelerability.

Further, the CPU 5*b* calculates the ignition timing θIG of the engine, based on the determined engine operating conditions. Driving signals corresponding to the Tout and θIG values calculated as above are delivered via the output circuit to the fuel injection valves 6 and the spark plugs 19, respectively, to drive them.

According to the fuel supply control system having the above described construction, when the intake pipe absolute pressure PBA or the throttle valve opening TH exceeds a predetermined value, the ECU 5 determines that the engine is in a wide open throttle (WOT) condition as a predetermined high load condition. Then, upon the lapse of a predetermined delay time, air-fuel ratio feedback control responsive to the output from the O2 sensor 16 is terminated, and fuel supply increase control based on the engine rotational speed NE and the intake pipe absolute pressure PBA is started.

Figure 2:
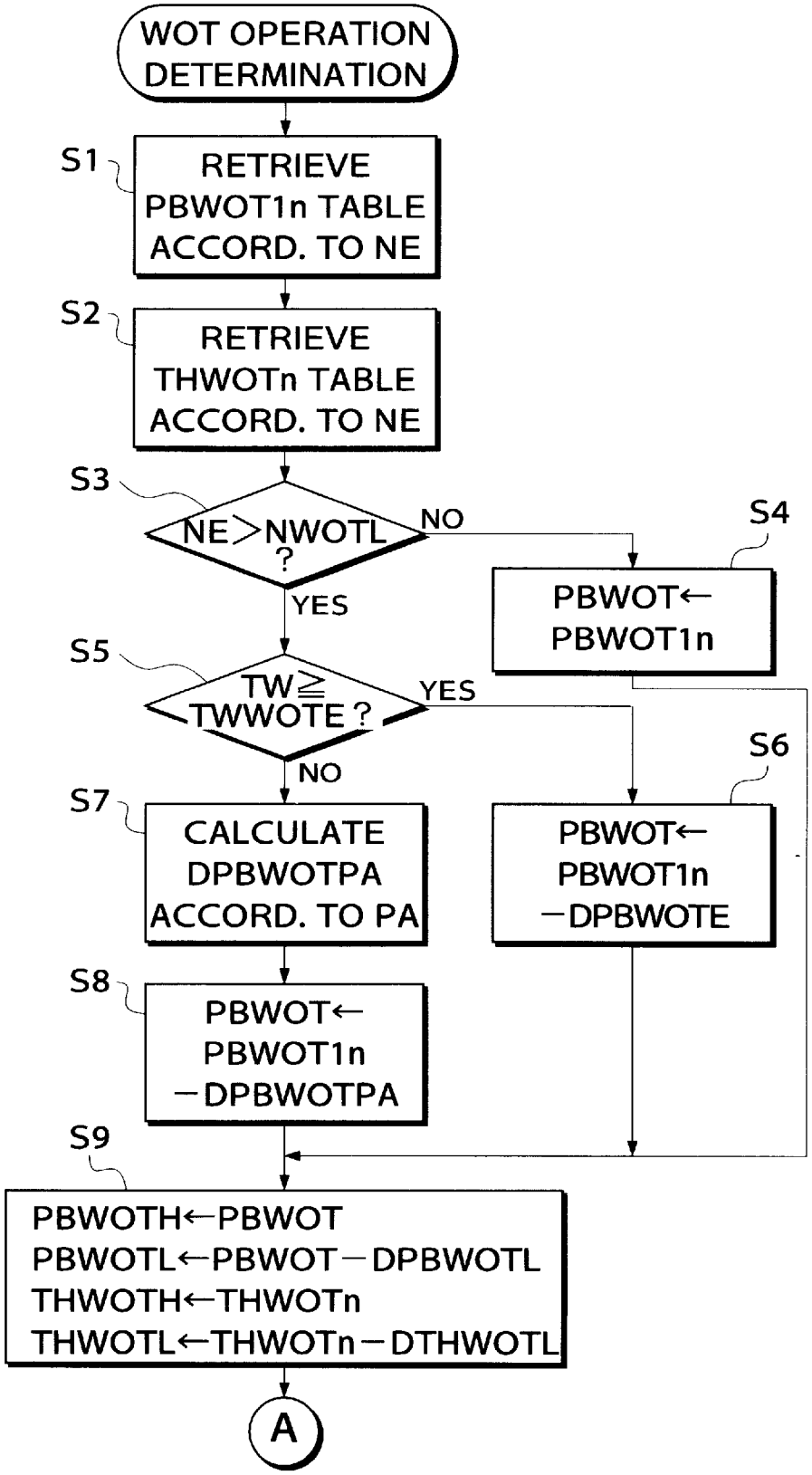
FIG. 2 is a flowchart showing a program for determining whether the engine is in a wide open throttle (WOT) condition.
Figure 3:
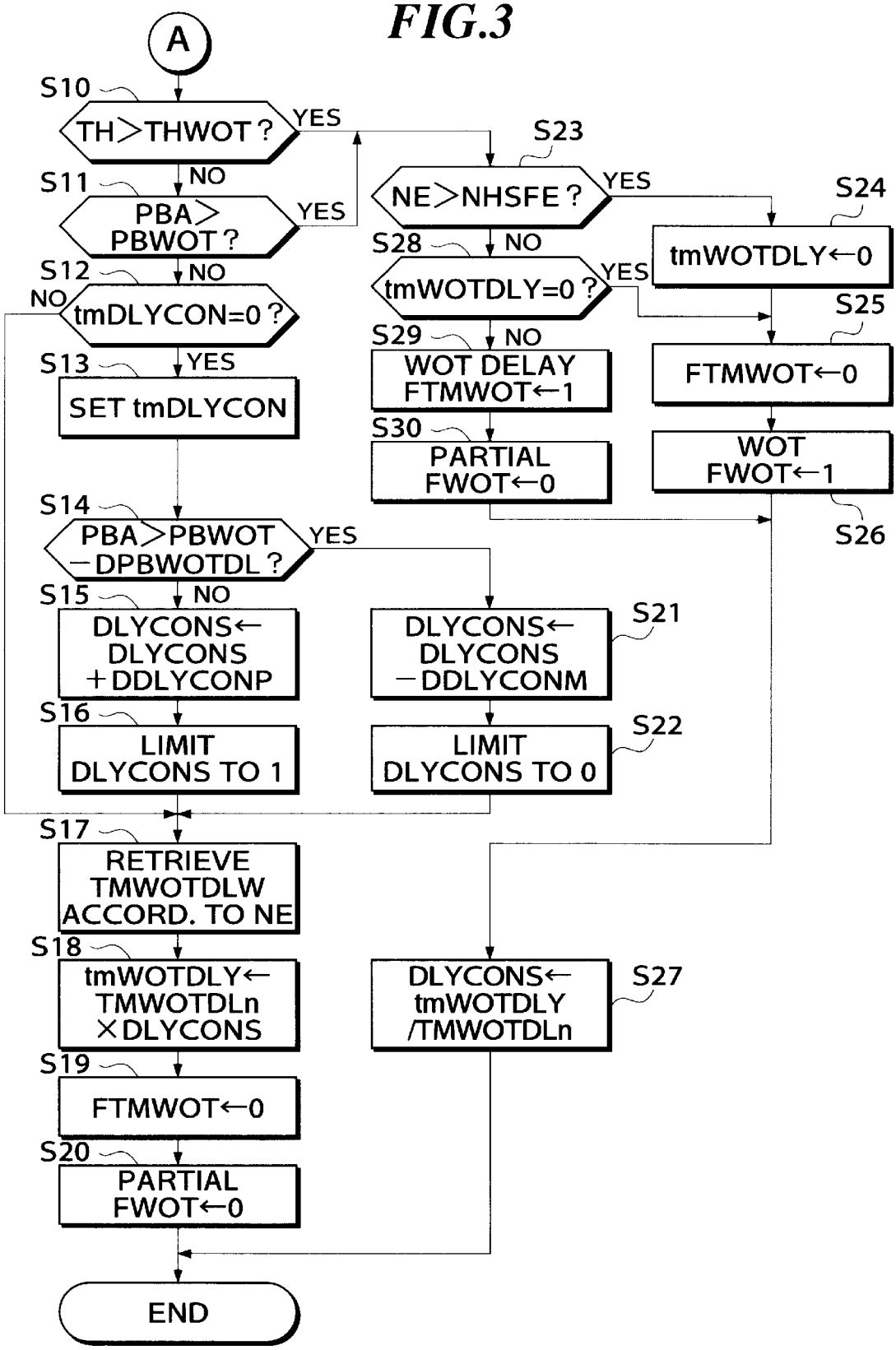
FIG. 3 is a continued part of the FIG. 2 program.

FIGS. 2 and 3 show a program for determining whether or not the engine is in the wide open throttle (WOT) condition, which is executed in synchronism with generation of TDC signal pulses. First, at steps S1 to S9, a threshold value PBWOT of the intake pipe absolute pressure PBA and a threshold value THWOT of the throttle valve opening TH are calculated.

Figure 4:
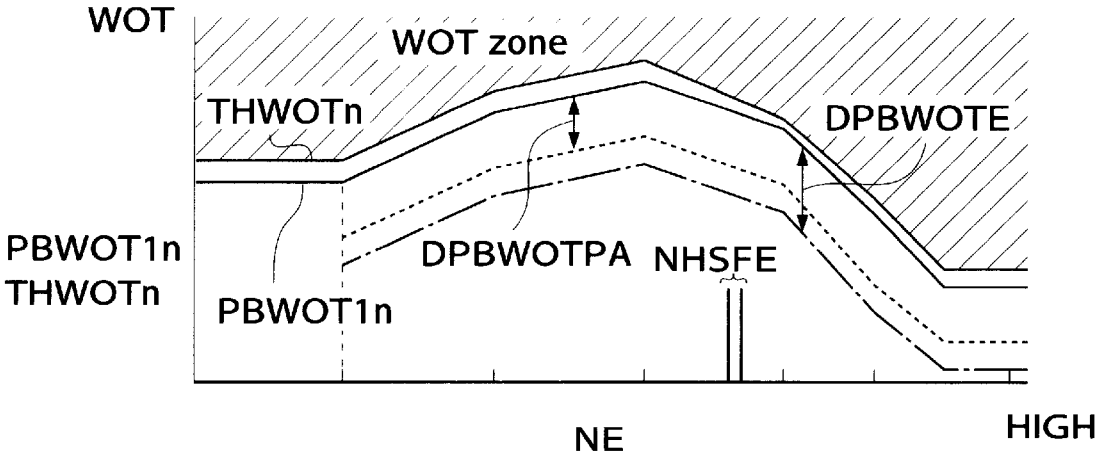
FIG. 4 shows a PBWOT1n TABLE and a THWOTn table.

More specifically, at the step S1, the ECU 5 retrieves a PBWOT1n table, shown in FIG. 4, to determine a threshold value PBWOT1n of the intake pipe absolute pressure PBA according to the engine rotational speed NE. Similarly, at the step S2, the ECU 5 retrieves a THWOTn table, also shown in FIG. 4, to determine a threshold value THWOTn of the throttle valve opening TH according to the engine rotational speed NE. In FIG. 4, a WOT region is indicated by the shaded portion, and when the engine rotational speed NE is in the vicinity of 3000 rpm, the threshold values PBWOT1n and THWOTn both assume the maximum values.

Then, it is determined at the step S3 whether or not the engine rotational speed NE is higher than a predetermined value NWOTL (e.g. 992 rpm). If the NE value is equal to or lower than the predetermined value NWOTL, the threshold value PBWOT is set to the threshold value PBWOT1n retrieved at the step S1, at the step S4.

On the other hand, if the NE value is higher than the predetermined value NWOTL, it is determined at the step S5 whether or not the engine coolant temperature TW is higher than a predetermined value TWWOTE. The predetermined value TWWOTE has a hysteresis, and according to the present embodiment, an upper value TWWOTEH of the predetermined value TWWOTE is set to 109.2° C. and a lower value TWWOTEL of the same is set to 103.4° C. If it is determined that the engine coolant temperature TW is equal to or higher than the predetermined value TWWOTE, the threshold value PBWOT is set to a value obtained by subtracting a predetermined high coolant temperature correction value DPBWOTE (e.g. 214 mmHg) from the threshold value PBWOT1n retrieved at the step S1, at the step S6.

Figure 5:
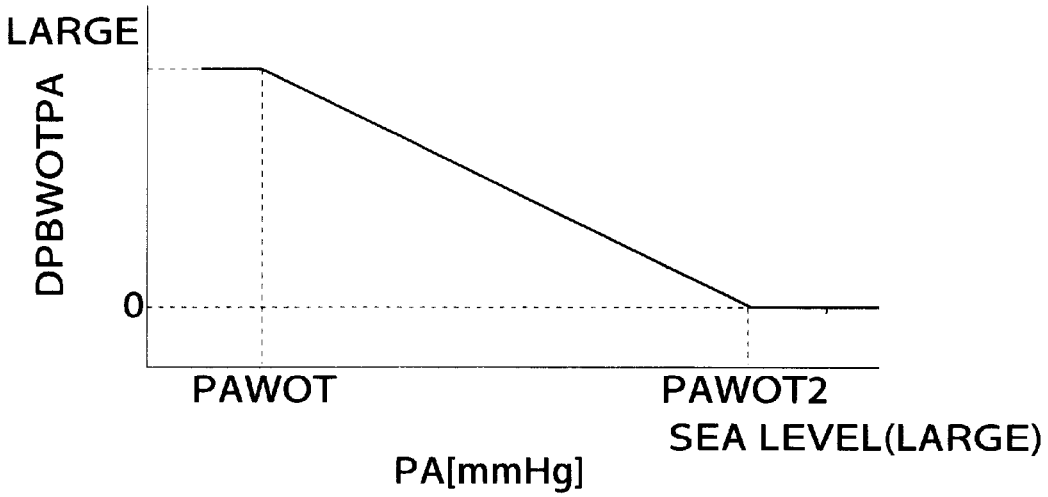
FIG. 5 shows a table for determining an atmospheric pressure-dependent correction value DPBWOTPA.

On the other hand, if the engine coolant temperature TW is not equal to or higher than the predetermined value TWWOTE, an atmospheric pressure-dependent correction value DPBWOTPA is determined from an atmospheric pressure-dependent correction value table according to the atmospheric pressure PA at the step S7, and the threshold value PBWOT is set to a value obtained by subtracting the atmospheric pressure-dependent correction value DPBWOTPA from the threshold value PBWOT1n retrieved at the step S1, at the step S8. FIG. 5 shows the DPBWOTPA table, which is set such that the atmospheric pressure-dependent correction value DPBWOTPA is set to a smaller value as the atmospheric pressure PA becomes higher.

At the step S9, a hysteresis is added to the threshold value PBWOT calculated at one of the steps S4, S6, and S8, and the threshold value THWOTn retrieved at the step S2. More specifically, an upper value PBWOTH of the threshold value PBWOT is set to the PBWOT value as it is, whereas a lower value PBWOTL of the same is set to a value obtained by subtracting a correction value DPBWOTL (e.g. 21.48 mmHg) from the threshold value PBWOT. Similarly, an upper value THWOTH of the threshold value THWOTn is set to the THWOTn value as it is, whereas a lower value THWOTL of the same is set to a value obtained by subtracting a correction value DTHWOT (e.g. 1.95 degrees) from the threshold value THWOT.

Then, it is determined at a step S10 whether or not a present value of the throttle valve opening TH is larger than the threshold value THWOT. If the throttle valve opening TH is larger than the threshold value THWOT, the program proceeds to a step S23. On the other hand, if the throttle valve opening TH is equal to or smaller than the threshold value THWOT, it is determined at a step S11 whether or not a present value of the intake pipe absolute pressure PBA is larger than the threshold value PBWOT. If the PBA value is larger than the threshold value PBWOT, the program proceeds to the step S23.

On the other hand, if the PBA value is equal to or smaller than the threshold value PBWOT, it is determined at a step S12 whether or not the count value of a down-counting timer tmDLYCON is equal to 0. The down-counting timer tmDLYCON is employed for updating a residual delay time ratio DLYCONS at predetermined time intervals (tmDLYCON). The residual delay time ratio DLYCONS represents a ratio of a residual time period (count value) of a down-counting timer tmWOTDLY, referred to hereinafter with reference to a step S18, to a basic delay time period TMWOTDLn of the same, i.e. tmWOTDLY/TMWOTDLn.

If the count value of the down-counting timer tmDLYCON is not equal to 0, the program jumps to a step S17, whereas if the count value of the down-counting timer tmDLYCON is equal to 0, the down-counting timer tmDLYCON is set to an initial value TMDLYCON (e.g. 200 msec) at a step S13.

Then, it is determined at a step S14 whether or not the intake pipe absolute pressure PBA is larger than a value obtained by subtracting the correction value DPBWOTDL from the threshold value PBWOT. More specifically, it is determined whether or not the engine is in a condition immediately before the WOT operation (hereinafter referred to as "the immediately-before-WOT condition"). The value (PBWOT−DPBWOTDL) obtained by subtracting the correction value DPBWOTDL from the threshold value PBWOT is set to a value of the intake pipe absolute pressure PBA at which the catalyst temperature TCAT is presumed to have a value assumed in the immediately-before-WOT condition. The correction value DPBWOTDL is set to e.g. 100 mmHg.

If the PBA value is equal to or smaller than the value (PBWOT−DPBWOTDL), which means that the engine is not in the immediately-before-WOT condition, an addend DDLYCONP is added to the residual delay time ratio DLYCONS at a step S15. If the residual delay time ratio DLYCONS after the addition exceeds a value of 1.0, the DLYCONS value is limited to 1.0 at a step S16. That is, if the engine is not in the immediately-before-WOT condition, the residual delay time ratio DLYCONS is set to a larger value to increase a delay time period before execution of increase of the fuel injection amount after the engine enters the WOT condition. The addend DDLYCONP is equal to a ratio (=t1/TMDLYCON) of a TCAT-declining time period t1 to the initial value TMDLYCON of the down-counting timer tmDLYCON. The TCAT-declining time period t1 is a time period required for the catalyst temperature TCAT to decline from a temperature at or above which the catalyst 15 can be deteriorated or damaged by heat to a temperature to be assumed when the engine is in the immediately-before-WOT condition.

Figure 6:
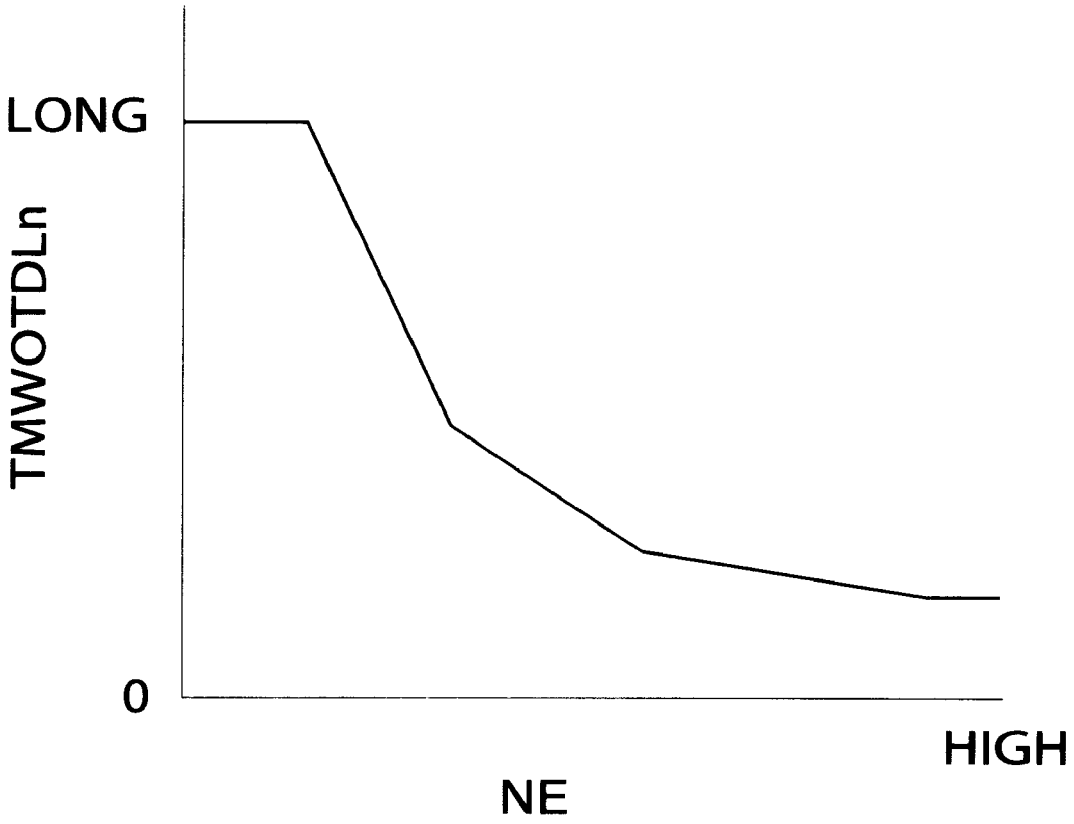
FIG. 6 shows a table for determining a basic delay time period TMWOTDLn.

At the step S17, a TMWOTDLn table is retrieved to determine a value of the basic delay time period TMWOTDLn according to the engine rotational speed NE. FIG. 6 shows the TMWOTDLn table, which is set such that the basic delay time TMWOTDLn is set to a shorter value as the engine rotational speed NE becomes higher. Further, the down-counting timer tmWOTDLY is set to a value obtained by multiplying the thus determined basic delay time period TMWOTDLn by the residual delay time ratio DLYCONS and started at the step S18.

Then, an immediately-before-WOT determination flag FTMWOT which, when set to "1", indicates that the engine is in the immediately-before-WOT condition, is set to 0 at a step S19, and a WOT determination flag FWOT which, when set to "1", indicates that the engine is in the WOT condition, is set to 0 at a step S20, followed by terminating the present routine. If the WOT determination flag FWOT is set to "0", partial opening control is carried out. The partial opening control is carried out such that the air-fuel ratio of a mixture supplied to the engine is feedback-controlled in response to the output from the O2 sensor 16 so as to make the air-fuel ratio of the mixture equal to a desired air-fuel ratio.

Further, if it is determined at the step S14 that the PBA value is larger than the value (PBWOT−DPBWOTDL), which means that the engine is in the immediately-before-WOT condition, a subtrahend DDLYCONM is subtracted from the residual delay time ratio DLYCONS at a step S21. If the residual delay time ratio DLYCONS after the subtraction is smaller than 0, the residual delay time ratio DLYCONS is limited to 0 at a step S22. The subtrahend DDLYCONM is equal to a ratio (=t2/TMDLYCON) of a TCAT-rising time period t2 to the initial value TMDLYCON of the down-counting timer tmDLYCON. The TCAT-rising time period t2 is a time period required for the catalyst temperature TCAT to rise from the temperature to be assumed when the engine is in the immediately-before-WOT condition to the temperature at or above which the catalyst 15 can be deteriorated or damaged by heat. Thereafter, the program proceeds to the step S17.

On the other hand, if the throttle valve opening TH is higher than the threshold value THWOT at the step S10 or if the intake pipe absolute pressure PBA is higher than the threshold value PBWOT, i.e. in the WOT condition, at the step S1, it is determined at the step S23 whether or not the engine rotational speed NE is higher than a predetermined value NHSFE. The predetermined value NHSFE has a hysteresis, and in the present embodiment, an upper value of the predetermined value NHSFE is set to 4000 rpm, and a lower value of the same is set to 3800 rpm.

If the engine rotational speed NE is higher than the NHSFE value, the down-counting timer tmWOTDLY is reset to 0 at a step S24, the immediately-before-WOT determination flag FTMWOT is set to 0 at a step S25, and the WOT determination flag FWOT is set to 1 at a step S26. Further, the residual delay time ratio DLYCONS is calculated at a step S27, followed by terminating the present routine. In the present case, since the down-counting timer tmWOTDLY is reset to 0 at the step S24, the residual delay time ratio calculated at the step S27 is equal to 0.

If it is determined at the step S23 that the engine rotational speed NE is equal to or lower than the predetermined value NHSFE, it is determined at a step S28 whether or not the count value of the down-counting timer tmWOTDLY is equal to 0. If the count value of the timer tmWOTDLY is equal to 0, i.e. if the set delay time period has elapsed, the program proceeds to the step S25 to set the immediately-before-WOT determination flag FTMWOT to 0, and then the WOT determination flag FWOT to 1 at the step S26.

On the other hand, if the count value of the timer tmWOTDLY is not equal to 0, i.e. if the set delay time period has not elapsed, the immediately-before-WOT determination flag FTMWOT is set to 1 at a step S29, to indicate that the WOT operation is not to be executed since the delay time period has not elapsed, followed by setting the WOT determination flag FWOT to 0 at a step S30.

Then, the residual delay time ratio DLYCONS is calculated at the step S27, followed by terminating the present routine. The calculated residual delay time ratio DLYCONS is multiplied by the basic delay time period TMWOTDLn in a subsequent loop of execution of the step S18, and the multiplied value is set to the down-counting timer tmWOTDLY as the delay time period for use in the next WOT operation.

As described above, according to the present embodiment, when the engine is in the WOT condition, it is determined whether or not the delay time period has elapsed, and if the delay time period has elapsed, the WOT determination flag FWOT is set to "1", to thereby start the fuel supply increase control. On the other hand, if the delay time period has not elapsed, the residual delay time ratio DLYCONS is updated while the partial opening control is continued. Further, when the engine is in the immediately-before-WOT condition, the residual delay time ratio DLYCONS is decreased, while when the engine is not in the immediately-before-WOT condition, the ratio DLYCONS is increased. Then, the basic delay time period TMWOTDLn is multiplied by the residual delay time ratio DLYCONS, and the resultant value is set to the down-counting timer tmWOTDLY as the delay time period for use in the next WOT operation. Although in the embodiment described above, the basic delay time period TMWOTDLn is set according to the engine rotational speed NE, the TMWOTDLn value may be set according to the engine rotational speed NE and the intake pipe absolute pressure PBA.

Figure 7:
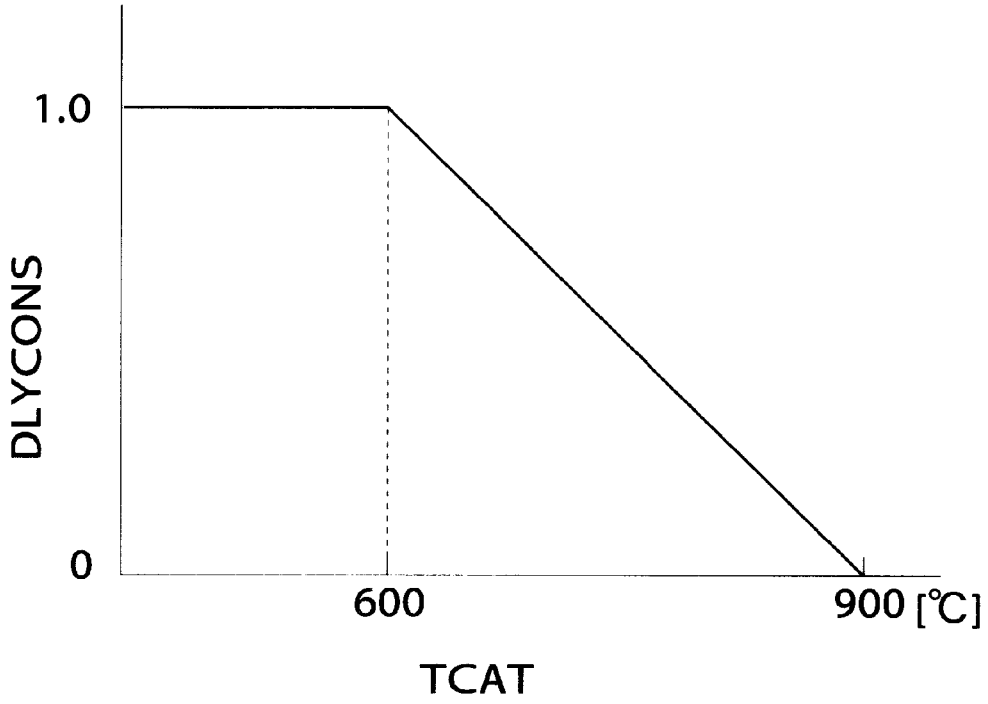
FIG. 7 shows a table for determining a residual delay time ratio DLYCONS according to the temperature TCAT of a catalyst appearing in FIG. 1.
Figures 8A, 8B, 8C, 8D, 8E:
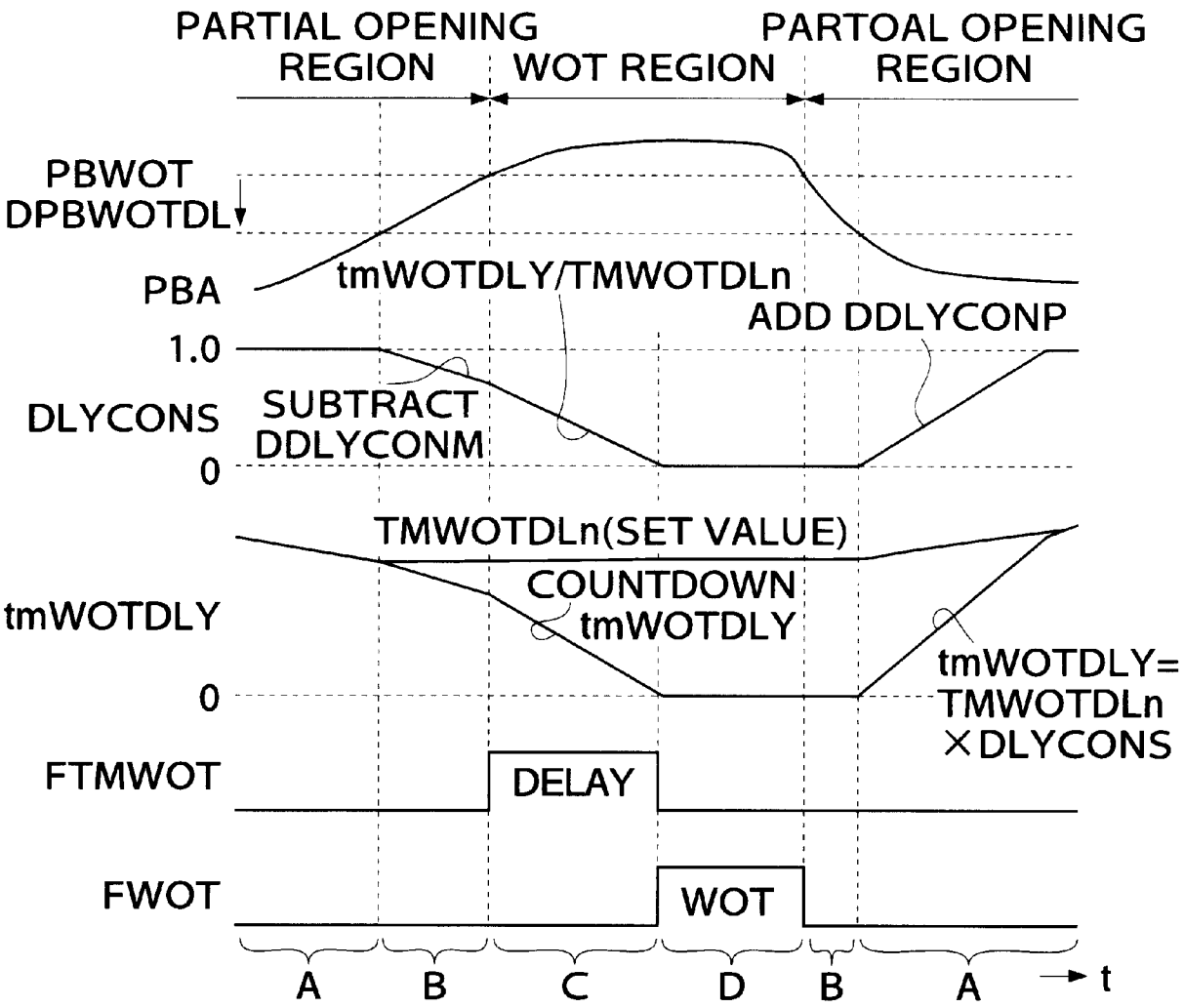

Next, the residual delay time ratio DLYCONS will be explained. FIG. 7 shows the relationship between the residual delay time ratio DLYCONS and the catalyst temperature TCAT, which is set in the following manner: The residual delay time ratio DLYCONS is set to 0 when the catalyst temperature TCAT assumes a value at or above which the catalyst 15 can be deteriorated or damaged by heat, e.g. 900° C., while the ratio DLYCONS is set to 1.0 when the catalyst temperature TCAT is below a temperature to be assumed when the engine is in the immediately-before-WOT condition, e.g. 600° C. When the catalyst temperature TCAT falls between the two temperature values, the residual delay time ratio DLYCONS is calculated by linear interpolation. That is, when the delay time period has elapsed after conditions for the WOT operation became satisfied, it is considered that the catalyst temperature TCAT has reached the temperature at or above which the catalyst 15 can be deteriorated or damaged by heat, and therefore the residual delay time ratio DLYCONS is set to 0. If the conditions for the WOT operation become unsatisfied before the delay time period elapses, however, it is considered that the catalyst temperature TCAT has been rising at a ratio of the residual time period of the delay time period to the set basic delay time period. Therefore, the residual delay time ratio DLYCONS is determined based on the above ratio.

Further, when the conditions for the WOT operation are unsatisfied, the residual delay time ratio DLYCONS is calculated depending upon whether or not the intake pipe absolute pressure PBA assumes a value at which the TCAT value reaches the temperature (e.g. 600° C.) to be assumed when the engine is in the immediately-before-WOT condition. More specifically, if the intake pipe absolute pressure PBA assumes a value at which the TCAT value exceeds the temperature to be assumed when the engine is in the immediately-before-WOT condition, the residual delay time ratio DLYCONS is decreased, whereas if the intake pipe absolute pressure PBA assumes a value at which the TCAT value does not exceed the temperature to be assumed when the engine is in the immediately-before-WOT condition, the residual delay time ratio DLYCONS is increased.

By multiplying the basic delay time period TMWOTDLn by the thus calculated residual delay time ratio DLYCONS, the delay time period to be used in the next WOT operation can be set based on the catalyst temperature TCAT.

FIGS. 8A to 8E collectively form a timing chart showing changes in the intake pipe absolute pressure PBA, the residual delay time ratio DLYCONS, the count value of the down-counting timer tmWOTDLY, the immediately-before-WOT determination flag FTMWOT, and the WOT determination flag FWOT.

(1) If PBA<PBWOT−DPBWOTDL holds, i.e. in a region A in FIGS. 8A to 8E, it is considered that the TCAT value is lower than a value to be assumed when the engine is in the immediately-before-WOT condition. Therefore, the addend DDLYCONP is added to the residual delay time ratio DLYCONS to thereby progressively increase the delay time period to be used in the next WOT operation.

(2) If PBA>PBWOT−DPBWOTDL and PBA<PBWOT hold, i.e. in a region B, it is considered that the TCAT value exceeds the value to be assumed when the engine is in the immediately-before-WOT condition. Therefore, the subtrahend DDLYCONM is subtracted from the residual delay time ratio DLYCONS to thereby progressively decrease the delay time period to be used in the next WOT operation.

(3) If PBA>PBWOT (or TH>THWOT) holds and at the same time the count value of the down-counting timer tmWOTDLY is not equal to 0, i.e. in a region C, the WOT operation is being delayed. Therefore, the immediately-before-WOT determination flag FTMWOT is set to "1", to thereby carry out the partial opening control. Further, the residual delay time ratio DLYCONS is calculated to the ratio of the residual time period of the down-counting timer tmWOTDLY to the basic delay time period TMWOTDLn.

(4) If the count value of the down-counting timer tmWOTDLY is equal to "0", i.e. in a region D, the WOT determination flag FWOT is set to "1", to thereby start the fuel supply increase control suitable for the WOT condition. Since at this time, the count value of the down-counting timer tmWOTDLY is equal to "0", the residual delay time ratio DLYCONS is set to "0".

According to the fuel supply control system of the present embodiment, as described hereinabove, the delay time period to be used in the next WOT operation can be set to a value according to the catalyst temperature TCAT. As a result, when the catalyst temperature TCAT has reached a value at or above which the catalyst can be deteriorated or damaged by heat, the fuel supply amount can be promptly increased, and therefore the catalyst can positively be prevented from being deteriorated or damaged by heat. Further, when the catalyst temperature TCAT is so low that it does not immediately reach the value at or above which the catalyst can be deteriorated or damaged by heat, the fuel supply amount is increased after the lapse of a delay time period corresponding to the catalyst temperature TCAT, to thereby improve exhaust emission characteristics and fuel economy of the engine.

What is claimed is:

1. A fuel supply control system for an internal combustion engine, comprising:

load condition-detecting means for detecting a load condition of said engine;

fuel amount-increasing means, for increasing an amount of fuel to be-supplied to said engine when a predetermined high load condition of said engine is detected by said load condition-detecting means;

delay time-setting means for setting a delay time period from detection of said predetermined high load condition of said engine by said load condition-detecting means to execution of increase of said amount of fuel by said fuel amount-increasing means, according to operating conditions of said engine;

counting means for counting a time period elapsed from said detection of said predetermined high load condition; and correcting means for correcting said delay time period set by said delay time-setting means, based on a ratio of said set delay time period to said time period counted by said counting means and said load condition of said engine detected by said load condition-detecting means before said detection of said predetermined high load condition.

2. A fuel supply control system as claimed in claim 1, wherein said correcting means decreases said delay time period when load on said engine detected by said load condition-detecting means is larger than a predetermined value to be assumed immediately before said engine enters said predetermine high load condition, and increases said delay time period when said load on said engine is smaller than said predetermined value.

3. A fuel supply control system as claimed in claim 1 or 2, wherein said delay time-setting means sets said delay time period, based on rotational speed of said engine assumed immediately before said engine enters said predetermined high load condition.

4. A fuel supply control system as claimed in claim 3, wherein said delay time-setting means sets said delay time period to a shorter value as said rotational speed of said engine is higher.

5. A fuel supply control system as claimed in claim 2, wherein said correcting means decreases said delay time period by subtracting a predetermined subtrahend from a residual delay time ratio which is a ratio of a residual time period of said counting means to said delay time period when said load on said engine detected by said load condition-detecting means is smaller than said predetermined value, and increases said delay time period by adding a predetermined addend to said residual delay time ratio when said load on said engine is larger than said predetermined value.

6. A fuel supply control system as claimed in claim 5, wherein said engine has an exhaust system, and a catalyst arranged in said exhaust system, said predetermined subtrahend being equal to a ratio of a time period required for temperature of said catalyst to rise from a temperature value to be assumed immediately before said engine enters said predetermined high load condition to a predetermined high temperature value to a time interval of the subtraction of said predetermined subtrahend from said residual delay time ratio by said correcting means.

7. A fuel supply control system as claimed in claim 5, wherein said engine has an exhaust system, and a catalyst arranged in said exhaust system, said predetermined addend being equal to a ratio of a time period required for temperature of said catalyst to decline from a predetermined high temperature value to a temperature value to be assumed immediately before said engine enters said predetermined high load condition to a time interval of the addition of said predetermined addend to said residual delay time ratio by said correcting means.

8. A fuel supply control system as claimed in claim 6 or 7, wherein said predetermined high temperature value is a value which said temperature of said catalyst can assume when said delay time period has elapsed after said engine entered said predetermined high load condition.

9. A fuel supply control system as claimed in claim 5, wherein said delay time-setting means sets said delay time period by multiplying a basic delay time period by said residual delay time ratio, said basic delay time period being set according to rotational speed of said engine.

10. A fuel supply control system as claimed in any of claims 5 to 7, including limiting means operable when said residual delay time ratio after the subtraction of said predetermined subtrahend therefrom falls below a predetermined lower limit value, for limiting said residual delay time ratio to said predetermined lower limit value, said predetermined lower limit value being set to a value such that said delay time period is made equal to 0.

11. A fuel supply control system as claimed in claim 10, wherein said predetermined lower limit value corresponds to said predetermined high temperature value.

12. A fuel supply control system as claimed in any of claims 5 to 7, including limiting means operable when said residual delay time ratio after the addition of said predetermined addend thereto exceeds a predetermined upper limit value, for limiting said residual delay time ratio to said predetermined upper limit value, said predetermined higher limit value being set to a value such that said delay time period is not corrected.

13. A fuel supply control system as claimed in claim 12, wherein said predetermined upper limit value corresponds to said temperature value to be assumed by said catalyst immediately before said engine enters said predetermined high load condition.

* * * * *